US010202859B2

(12) United States Patent
Biemar

(10) Patent No.: US 10,202,859 B2
(45) Date of Patent: Feb. 12, 2019

(54) AXIAL TURBOMACHINE BLADE WITH PLATFORMS HAVING AN ANGULAR PROFILE

(71) Applicant: Techspace Aero S.A., Herstal (Milmort) (BE)

(72) Inventor: Guy Biemar, Blegny (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 967 days.

(21) Appl. No.: 14/092,542

(22) Filed: Nov. 27, 2013

(65) Prior Publication Data

US 2014/0147265 A1 May 29, 2014

(30) Foreign Application Priority Data

Nov. 29, 2012 (EP) ..... 12194852

(51) Int. Cl.
*F01D 9/04* (2006.01)
*F01D 17/16* (2006.01)
(Continued)

(52) U.S. Cl.
CPC ..... *F01D 9/042* (2013.01); *F01D 17/162* (2013.01); *F04D 29/542* (2013.01);
(Continued)

(58) Field of Classification Search
CPC ..... F01D 9/042; F01D 9/04; F01D 25/243; F01D 17/16; F01D 17/162; F04D 29/542;
(Continued)

(56) References Cited

U.S. PATENT DOCUMENTS 2,393,447 A * 1/1946 Allen ..... F01D 5/3038 29/889.21
2,405,146 A * 8/1946 Huber ..... F01D 5/3061 416/212 R
(Continued)

FOREIGN PATENT DOCUMENTS

EP 2236773 A2 10/2010
EP 1936121 B1 5/2012
(Continued)

OTHER PUBLICATIONS

Search Report dated Apr. 12, 2013 for EP 12194852.5.
(Continued)

*Primary Examiner* — David E Sosnowski
*Assistant Examiner* — Wayne A Lambert
(74) *Attorney, Agent, or Firm* — James E. Walton

(57) ABSTRACT

A stator blades of an axial turbomachine intended to be fitted on a ferrule in an annular row of identical blades. Each blade includes a platform with opposed lateral edges and a screw to the ferrule. The contour of the platform has, at each of the lateral edges, an angular profile designed to mate with the contiguous edge of the platform of an adjacent blade. This feature enables the angular position or pitch of the blade to be set. In a blade row fixed on a stator, mechanical clearances J1, J2, J3 and the fixation screws cause an average angular orientation error. The blades are made with a compensatory angle to offset the angular orientation error.

10 Claims, 4 Drawing Sheets

(51) Int. Cl.
*F04D 29/54* (2006.01)
*F04D 29/56* (2006.01)

(52) U.S. Cl.
CPC ..... *F04D 29/563* (2013.01); *F05D 2230/64* (2013.01); *F05D 2260/30* (2013.01); *Y10T 29/49321* (2015.01)

(58) Field of Classification Search
CPC ..... F04D 29/563; F05D 2230/64; F05D 2260/30; Y10T 29/49321; Y10T 29/49323
See application file for complete search history.

(56) References Cited

U.S. PATENT DOCUMENTS 2,447,942 A * 8/1948 Imbert ..... F01D 9/041 415/136
2,475,772 A * 7/1949 Allen ..... B23K 37/0443 228/159
2,488,875 A * 11/1949 Morley ..... F01D 9/042 415/136
2,606,742 A * 8/1952 Giles ..... F01D 5/30 29/889.21
2,622,790 A * 12/1952 McLeod ..... F01D 9/042 220/23.2
2,755,064 A 7/1956 Simonsen
2,801,822 A * 8/1957 Speed ..... F01D 5/30 415/209.3
4,245,954 A * 1/1981 Glenn ..... F01D 5/284 415/200
4,465,432 A * 8/1984 Mandet ..... F01D 5/3038 416/215
4,585,390 A * 4/1986 Pirtle ..... F01D 9/042 415/160
4,639,189 A * 1/1987 Rosman ..... F01D 9/041 415/115
4,878,811 A * 11/1989 Jorgensen ..... F01D 11/006 416/190
5,017,091 A * 5/1991 Tran ..... F01D 5/3007 29/889.21
5,039,277 A * 8/1991 Naudet ..... F04D 29/563 415/150
5,133,643 A * 7/1992 Ortolano ..... F01D 5/225 269/43
5,269,651 A * 12/1993 Ostermeir ..... F01D 9/041 415/134
5,743,711 A * 4/1998 Fournier ..... F01D 5/3015 415/209.2
5,984,633 A * 11/1999 Bachinger ..... F01D 9/041 29/412
6,296,442 B1 * 10/2001 Tran ..... F01D 9/042 29/889.22
6,435,821 B1 * 8/2002 Nicolson ..... F01D 5/147 415/148
7,722,321 B2 * 5/2010 Lhoest ..... F01D 9/042 415/209.3
8,123,471 B2 * 2/2012 Mielke ..... F01D 17/162 415/160
2001/0019695 A1 * 9/2001 Correia ..... F01D 5/143 415/135
2004/0067131 A1 * 4/2004 Joslin ..... F01D 5/225 415/139
2007/0014667 A1 * 1/2007 Pickens ..... F01D 5/3038 416/193 A
2008/0131268 A1 * 6/2008 Guemmer ..... F04D 29/563 415/160
2008/0206049 A1 * 8/2008 Depaepe ..... F01D 9/042 415/208.1
2009/0164037 A1 * 6/2009 Menuey ..... F01D 5/225 700/103
2009/0175719 A1 * 7/2009 Derclaye ..... B29C 39/10 415/208.1
2009/0185899 A1 * 7/2009 Bouchard ..... F01D 9/02 415/209.3
2011/0033285 A1 * 2/2011 Turi ..... F01D 9/044 415/182.1
2013/0149133 A1 * 6/2013 Ring ..... F01D 5/225 415/208.2

FOREIGN PATENT DOCUMENTS

FR 1548701 A 12/1968
RU 2171380 C2 7/2001

OTHER PUBLICATIONS

Request of the Substantive Examination dated Feb. 24, 2015 corresponding to U.S. App. No. 2013152402/06.
First Office Action dated Jan. 30, 2015 corresponding to CN App. No. 201310757188.X.

* cited by examiner

AXIAL TURBOMACHINE BLADE WITH PLATFORMS HAVING AN ANGULAR PROFILE

This application claims priority under 35 U.S.C. § 119 to European Patent Application No. 12194852.5, filed 29 Nov. 2012, which is incorporated herein by reference for all purposes.

BACKGROUND

1. Field of the Application

The present application relates to the rotor blades of an axial turbomachine, more particularly to the stator of an axial turbomachine. The present application also relates to a stator and an axial turbomachine comprising the stator. The present application relates to the angular setting of the blades of an axial turbomachine. The present application also relates to a method of assembling the axial turbomachine, particularly its stator(s).

2. Description of Related Art

In order to achieve high performance, axial turbomachines have several compressors and possibly several turbines which respectively compress and expand air. Each compressor and each turbine commonly has several rows of alternating rotor and stator blades. The pitch angles of the blades on successive stages differ incrementally, thereby gradually compressing the air before it enters the combustion chamber and gradually expanding the exhaust gas.

The pitch is a factor that is calculated for each blade row in order to optimise the efficiency of a given row, and the overall performance of a turbomachine. To construct such a row, several solutions are possible. For example, the array can be fabricated from blades welded to a ferrule, housing or rotor. The blades may also be attached with threaded studs or lockbolts. By providing each blade with two fixing pins it is prevented from rotating. However, this solution is particularly heavy because of the existence of the second fixing pin.

To save weight, it is advantageous to use only one fixing pin. However, this latter can no longer prevent the blade from rotating so that it maintains its pitch. The pitch may nevertheless be maintained by fitting the blade with a platform which is placed in an annular groove the shoulders of which offer an abutment at the corners of the rectangle.

Patent EP 1936121 B1 discloses a turbomachine having such a blade with a platform housed in such an annular groove. The blade is fastened by means of a nut screwed onto its threaded shaft. But this solution has manufacturing constraints. It requires a groove, thereby involving thickening in one place. If one of the materials of which a platform or the groove is made has insufficient hardness, this material may be deformed as the nut is being tightened. Therefore, the accuracy of the blade pitch may be degraded.

Although great strides have been made in the area of blades for axial turbomachines, many shortcomings remain.

DETAILED DESCRIPTION OF THE PREFERRED EMBODIMENT

Figure 1:
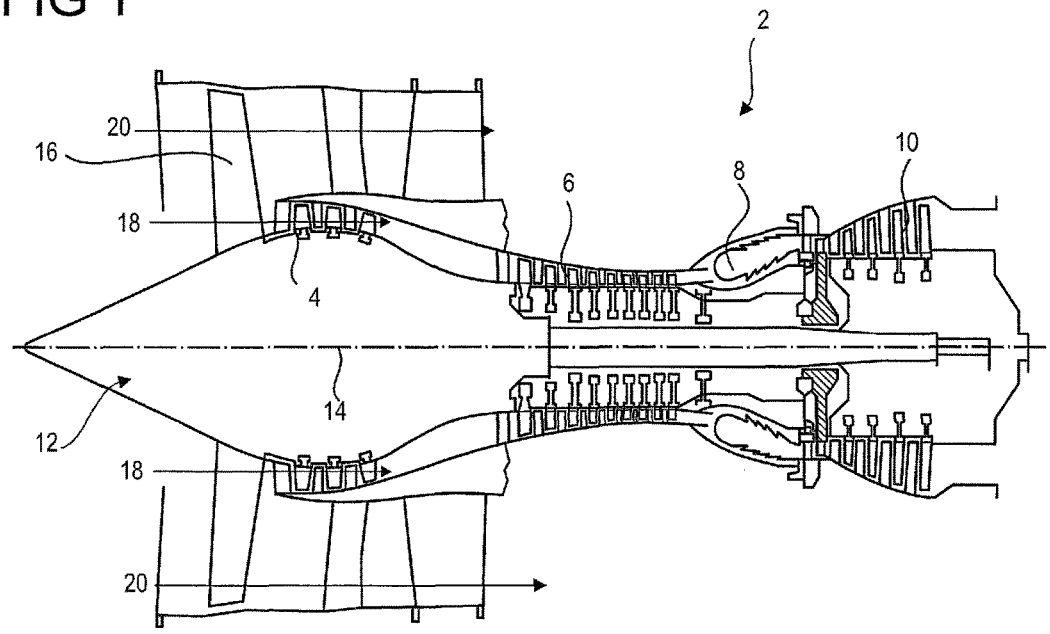
FIG. 1 shows an axial turbomachine in accordance with the present application.

The present application aims to solve at least one of the problems presented by the prior art. The present application aims to provide a solution for setting the pitch angle of a stator blade. More particularly, the present application aims to provide a blade design that reduces the turbomachine's manufacturing costs while ensuring the pitch is set correctly.

The present application relates to a stator blade of an axial turbomachine, intended to be fixed to a ferrule in an annular row of identical blades, the blade comprising a platform with a means of attachment to the ferrule enabling angular adjustment of the blade, an upstream edge, a downstream edge and two lateral opposing edges, wherein the shape of the platform has at each of its lateral edges a angular profile designed to marry with the contiguous edge of the platform of an identical adjacent blade so as to ensure the angular positioning of the blade in at least one direction of rotation.

The lateral edges may be made to line up generally by transverse translation. Transverse translation means a translation along the direction of the circumference of the blade row.

The lateral edges may be configured to line up predominantly along a rotation in space around the turbomachine's axis of rotation. This precision is useful for blade rows located on an inclined surface. Geometrically, this angle results in a reduction of the widths of the platforms downstream or upstream.

According to an advantageous embodiment of the present application, the transverse width of the platform remains substantially constant.

According to an advantageous embodiment of the present application, the angular profile has at least one contact part generally inclined to the axis of the turbomachine by an angle greater than or equal to 20°, preferably greater than or equal to 45°, more preferably equal to or greater than or equal to 70°. Optionally, this angle may be substantially equal to 90°.

According to an advantageous embodiment of the present application, the, or at least one of the, contact part(s) of the angular profile is generally straight.

According to an advantageous embodiment of the present application, the upstream and downstream edges are generally straight and parallel to the axis of the turbomachine being generally perpendicular to the said edges.

According to an advantageous embodiment of the present application, the means of attachment on the platform comprises means of clamping by rotation, arranged essentially at the centre of the platform, the or at least one of those contact part(s) of the angular profile being positioned to bear against the corresponding profile of the contiguous edge of the adjacent blade when the platform rotates in the direction of clamping of the means of attachment.

According to an advantageous embodiment of the present application, the contact part of the angular profile is part of a projected area of the corresponding lateral edge of the platform.

According to an advantageous embodiment of the present application, each of the lateral edges of the platform further comprises a recessed area, the projected and recessed areas being located and positioned on either side of a transverse axis passing through the blade's centre of rotation. Where the recessed area is adjacent to one of the upstream and downstream edges, it has in addition a cut-out.

According to an advantageous embodiment of the present application, the profile of each of the lateral edges of the platform has a generally square central part and a contact part upstream or downstream, preferably at each of the two upstream and downstream positions.

According to an advantageous embodiment of the present application, the means of attachment comprises a pin extending from one face of the platform, the said face acting as a face for mounting to the ferrule.

The present application also relates to the stator of an axial turbomachine comprising a ferrule with an inner surface and an annular row of blades comprising identical platforms arranged side-by-side on the inner surface of the ferrule, wherein the blades are in accordance with the present application, several adjacent blades having at least a part of their angular profile on the same lateral side bearing against the corresponding profile of the adjacent blade.

According to an advantageous embodiment of the present application, the means of attachment on the platform comprises a means of clamping by rotation, arranged essentially at the centre of the platform, the or at least one of those contact part(s) of the angular profile being positioned to bear against the corresponding profile of the contiguous edge of the adjacent blade when the platform rotates in the direction of clamping of the means of attachment, and the blade platforms have some mechanical clearance between them corresponding to a tolerance for the angular positioning of the blades, the angular profiles of the plurality of consecutive blades being in mutual contact in the direction of clamping the means of attachment.

According to an advantageous embodiment of the present application, the plurality of adjacent blades are configured to rotate more than 20', preferably more than 40', more preferably more than 80', even more preferably more than 120' around their means of attachment when they are not clamped down. The adjacent blades are configured to rotate more than 0.333°, 0.666°, and 2° around their fixation portion when they are not clamped.

According to another advantageous embodiment of the present application, the ferrule has a substantially constant thickness.

According to an advantageous embodiment of the present application, the ferrule has an essentially smooth mounting surface in contact with the platforms.

According to yet another advantageous embodiment of the present application, the housing is made of composite material.

The present application also relates to a compressor having at least one annular row of blades, wherein the blades of the blade row are in accordance with the present application.

The present application also relates to an axial turbomachine with a compressor and/or turbine fitted with a stator, wherein the stator is in accordance with the present application, and/or the compressor is in accordance with the present application.

The present application also relates to a method of fixing an annular row of blades on a stator ferrule of an axial turbomachine, the blades being in accordance with the present application and the means of attachment of the platforms comprising a means of clamping by rotation, located essentially at the centre of the platforms, the or at least one of the contact part(s) of the angular profiles being positioned so as to bear against the corresponding profile of the corresponding edge of the adjacent blade when the platforms rotate in the direction of clamping of the means of attachment, wherein it comprises the following steps:

(a) fixing a reference blade substantially in the final angular position of the said row, (b) successively placing a plurality of blades on the ferrule so as to construct the said blade row with the reference blade, (c) successively clamping the means of attachment of the plurality of blades starting from the reference blade, so as to successively bring the or at least one of the contact part(s) of the angular profile of each of the said blades to bear on the corresponding contiguous profile of the previous blade.

According to an advantageous embodiment of the present application, step (b) covers only part of the circumference of the stator; step (a) is carried out at several locations on the said circumference.

According to an advantageous embodiment of the present application, the reference blade is a dummy blade equivalent to at least two contiguous blades, and in that the method further comprises the step of:

(d) replacing the dummy reference blade(s) by blades in accordance with the other blades.

According to an advantageous embodiment of the present application, the number of reference blades is less than 1/10 of the total number of stator blades, preferably less than 1/15, more preferably less than 1/20.

The present application allows the pitch to be set accurately for a blade row without having recourse to a shoulder on the mounting, such as a ferrule. In this way, the means of support can be made lighter. This feature also enables a mounting to be made of a composite material, which provides a further opportunity to reduce weight.

The pitch setting achievable by the present application requires conventional surface finishes; the mechanical clearances can be increased locally. Thus, the present application reduces manufacturing costs. In addition, the present application simplifies the measurements and tests necessary to achieve a given pitch. This feature also enables savings to be made.

In the following description, the terms 'inner' and 'outer' refer to a position relative to the axis of rotation of an axial turbomachine. The terms 'transverse' and 'lateral' are expressed with respect to the longitudinal direction of the turbomachine and the stator, this direction corresponding to the axis of rotation of the machine.

FIG. 1 shows an axial turbomachine. In this case it is a double-flow turbojet. The turbojet 2 comprises a first compression stage, a so-called low-pressure compressor 4, a second compression stage, a so-called high pressure compressor 6, a combustion chamber 8 and one or more turbine stages 10. In operation, the mechanical power of the turbine 10 is transmitted through the central shaft to the rotor 12 and drives the two compressors 4 and 6. Reduction mechanisms may increase the speed of rotation transmitted to the compressors. Alternatively, the different turbine stages can each be connected to compressor stages through concentric shafts. These latter comprise several annular rotor blade rows associated with stator blade rows. The rotation of the rotor around its axis of rotation 14 generates a flow of air and gradually compresses it up to the inlet of the combustion chamber 8.

An inlet fan, commonly designated a 'turbofan' 16, is coupled to the rotor 12 and generates an airflow which is divided into a primary flow 18 passing through the various above-mentioned levels of the turbomachine, and a secondary flow 20 passing through an annular conduit (shown in part) along the length of the machine and then rejoins the main flow at the turbine outlet.

Figure 2:
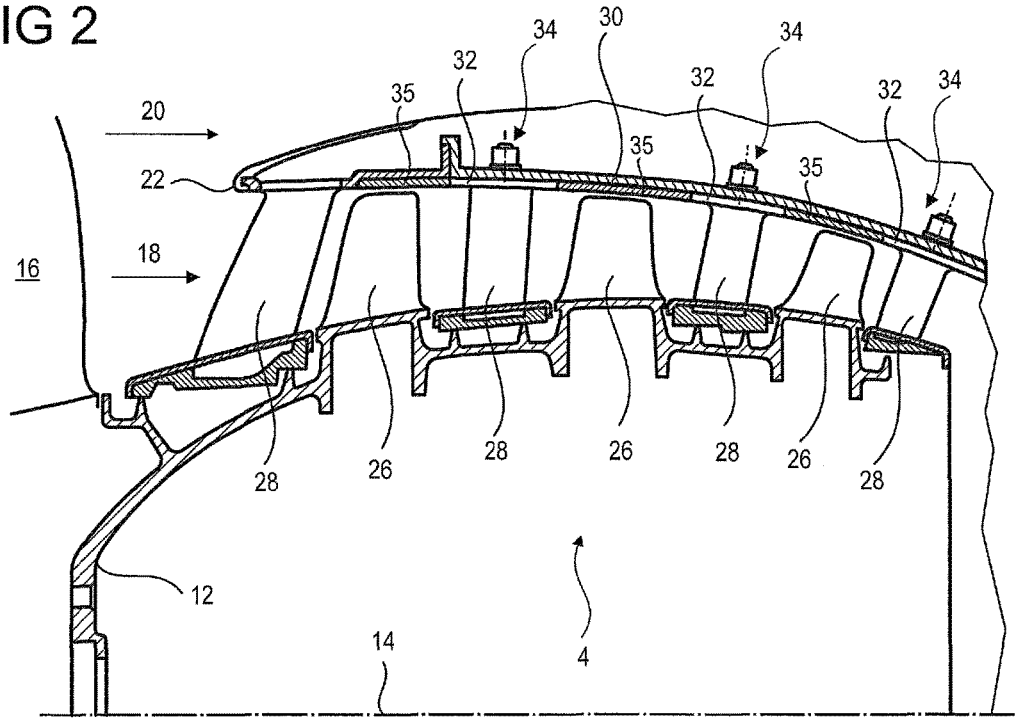
FIG. 2 is a view of the low-pressure compressor of the axial turbomachine of FIG. 1, the compressor having several stators in accordance with the present application.

FIG. 2 is a sectional view of a low-pressure compressor 4 of an axial turbomachine 2 such as that of FIG. 1. Part of the turbofan 16 can be seen, as can the splitter nose 22 between the primary 18 and secondary 20 airflows. The rotor 12 comprises several rows of rotor blades 26, for example three, and several rows of stator blades 28, for example four. Each row of stator blades 28 is associated with a row of rotor blades 26 for straightening the airflow so as to convert the velocity of the flow into pressure. Each pair of rotor blade rows with the associated stator form a stage of the compressor 4.

The low-pressure compressor 4 has a mechanically welded stator with a housing 30 acting as a mounting for the stator blades 28. The housing 30 forms a wall indirectly defining the primary flow 18. It may have a substantially smooth inner surface, preferably free of any lip. It has a shape of revolution about the axis of rotation 14 of the low-pressure compressor 4, which corresponds to the axis of the turbomachine. Its profile of revolution can be curved and closer to the axis 14 downstream. The housing 30 may comprise or form a plurality of annular members, such as ferrules arranged axially relative to each other so as to extend along the length of the compressor. It is noteworthy that at the fourth row of stator blades 28, the housing has an inclination greater than 15°. Optionally, the angle may be greater than 25°.

The stator blades 28 include platforms 32 pressed against the inner surface of the housing 30. They can be essentially flat or curved surfaces. Their surfaces in contact with the housing 30 are generally smooth. The contact between the platform 32 and the inner surface of the housing 30 is almost planar. The inclination of the platforms 32 with respect to the axis of rotation 14 increases substantially in the downstream rows.

Strips 35 of abradable material are applied between the rows of stator blades 28. More specifically, these strips 35 are located between the platforms 32 of the different rows of stator blades 28. The thickness of the strips is substantially equal to the overall thickness of the platforms 32.

The stator blades 28 are attached to the housing 30 by a means of attachment 34. The means of attachment 34 extends from its platform in a direction opposite to the aerodynamic part of the blade. The means of attachment are substantially cylindrical. The means of attachment 34 may comprise a fixing pin such as a screw or stud designed to have nut fitted. Preferably, the means of attachment of each blade comprises substantially a fixing pin. These are inserted into openings made in the housing 30.

The means of attachment comprise means of clamping, for example nuts designed to be fitted to a screw or stud. The clamping force of the means of clamping can easily rotate a blade about its means of attachment 34 since its platform 32 is smooth and is in planar contact with the housing 30.

Figure 3:
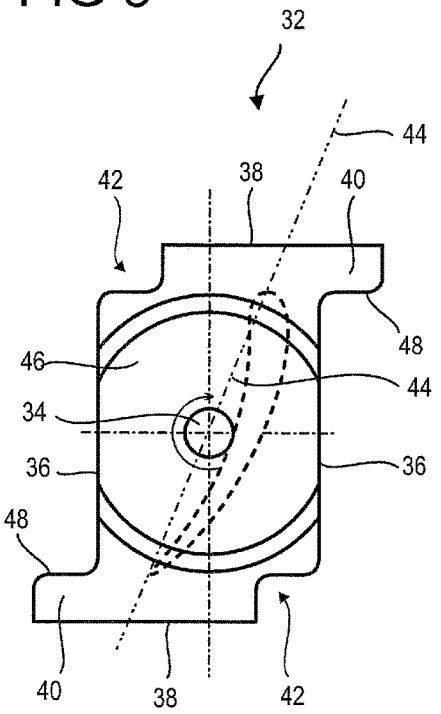
FIG. 3 is a first view of an axial turbomachine blade according to a first embodiment of the present application.

In order to inhibit this rotation the platforms 32 have special contours. FIG. 3 is a platform 32 according to a first embodiment of the present application. The platform 32 may have a generally quadrilateral shape such as a rectangle, a trapezium or a parallelogram. The contour of the platform 32 comprises lateral opposite edges 36 and two transverse edges 38 which are arranged perpendicularly to the axis of rotation 14, one being upstream of the blade body and the other being downstream. The platform 32 has a reverse Z-shape. The lateral edges 36 have an angular profile and embody physical interference, thus preventing rotation.

The angular profiles of the edges 36 each comprise a contact part 48 coming into contact with the corresponding part of the adjacent edge of an adjacent blade. This contact embodies physical interference. The contact parts 48 each have a projecting part 40. Each contact part 48 is inclined relative to the axis of rotation of the turbomachine by an angle greater than 10°, preferably greater than 30°, more preferably greater than 60°. This angle optionally is roughly equal to 90°. The angular profiles also each comprise a recessed area 42 relative to the general rectangular shape of the platform. The recessed area matches the projection on the opposite edge.

According to a preferred embodiment of the present application, the platforms 32 on one row of blades are identical. Thus, a projecting area of a platform 32 may marry with a recessed area or cut-out 42 of an adjacent platform 32. The contiguous lateral edges 36 interpenetrate and stop the platforms 32 rotating around at least one, optionally two, axis/axes of rotation about their means of attachment 34. Thus, the angular orientation of a stator blade 28 can be controlled precisely during assembly. The angular orientation of stator blades can be achieved reliably and repeatedly. Pitch measurement activities can be reduced, possibly eliminated.

The angular orientation or pitch of a blade is determined by the angle which the chord 44 of a blade makes with the axis of rotation 14 of the turbomachine 2. The chord used for this measurement is that at the junction with the platform 32.

The contact part 48 from one lateral edge bears against the corresponding part of the contiguous edge of the adjacent blade when the blade rotates as it is being clamped. In the platform shown in FIG. 3 clamping causes clockwise rotation. The contact part is generally parallel to the transverse direction, corresponding to the circumferential direction of the blade row. For this reason, the contact force between two adjacent blades generates little or no force in the transverse direction. In addition, this contact enables angular positioning independent of the tolerances in the distances between the blades, more precisely between the openings in the ferrule holding the means of attachment 34. Tolerances in the distances between the openings are larger than those relating to their alignment along the circumference of the ferrule.

The platform 32 is made of metal, preferably titanium. It can be integral with the body of the blade. To meet a specific shape, its contour is machined and possibly adjusted to meet strict tolerances.

The lateral edges 36 have similar profiles, preferably identical. Note that the profiles in generally coincide if they are translated over a distance equal to the width of the platform 32, in a direction oriented along the transverse edges (upstream and downstream) 38. The platform 32 has a generally constant width. The width may decrease substantially downstream due to the curvature of the housing 30. The width is measured transversely. The two profiles are substantially symmetrical with respect to the centre of the means of attachment.

The two profiles can be matched exactly in the case of the platforms 32 by translation parallel to the axis of rotation 14. Regarding the inclined platforms 32, especially those in the last row of stator blades, the two profiles are significantly divergent. Both profiles can be matched by performing an isometry, namely a rotation about the axis of rotation 14 of the turbomachine.

The platform 32 has a thickening 46. This latter forms a disc cut laterally by the longitudinal edges 36. Due to the awkward shape of the ferrule or housing 30, the contact with the disc can be at two points or two upstream and downstream edges. These contacts facilitate a slight degree of movement when mounting a blade row and improve the positioning and automatic orientation of the blades.

Figure 4:
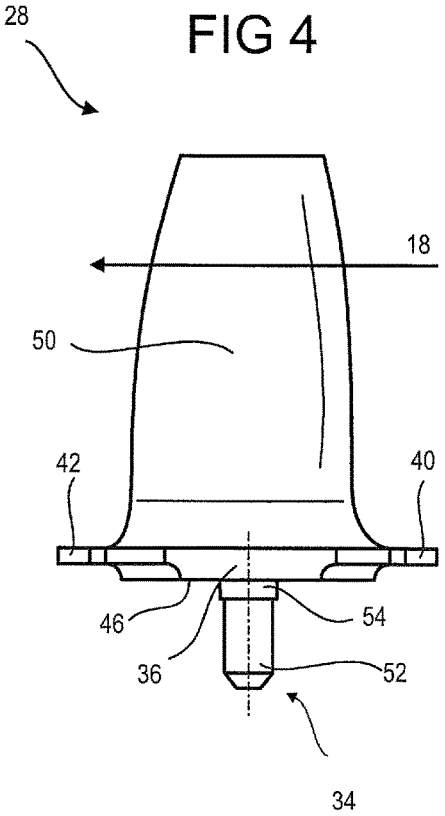
FIG. 4 is a second view of the blade in FIG. 3.

FIG. 4 shows the stator blade 28 of FIG. 1, according to the first embodiment of the present application. It has a body 50, or airfoil 50, forming a contoured surface designed to extend into the primary flow 18. Its shape can change the direction of flow. The head of the blade may have devices for attachment to an inner ferrule.

At the thickening 46, the lateral edges 36 have a greater height. Thus, the platforms offer better locking against rotation and tangential translation. The means of attachment 34 may comprise a smooth cylindrical surface 54 which is inserted into the thickness of the housing 30. It also includes a threaded portion 52 outside the housing 30.

Figure 5:
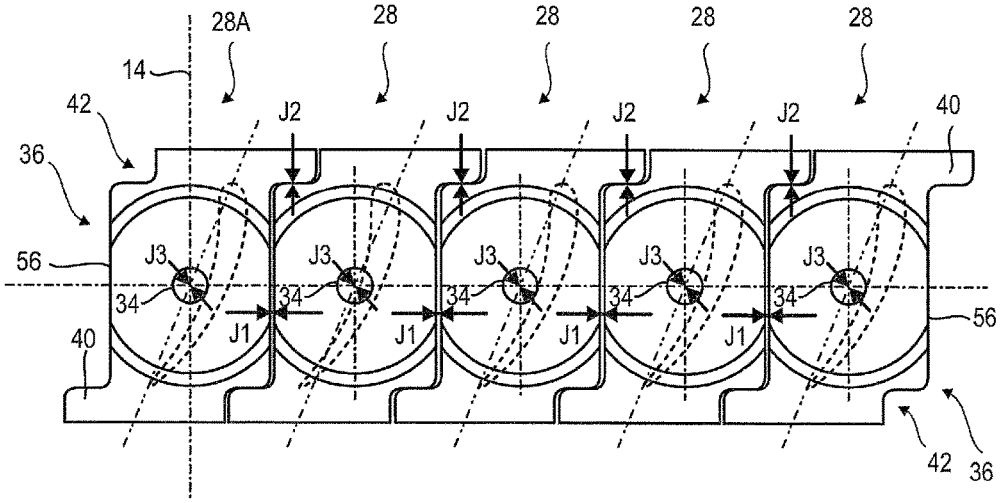
FIG. 5 illustrates an annular row of blades of a stator, the blades corresponding to FIGS. 3 and 4.

To facilitate the installation of a blade row, mechanical clearances are provided in the platforms 32 and the means of attachment 34. FIG. 5 shows part of a row of blades according to the first embodiment of the present application. The row, which generally forms a ring, in shown in plan view here. To enable the row to be assembled, a mechanical clearance at the lateral edges 36 is defined. J1 is the first mechanical clearance between the straight portions 56 of the lateral edges 36, and J2 is the second mechanical clearance between the curved parts of the lateral edges 36. The straight parts 56, of two, preferably of all, the adjacent blades may be spaced apart from each other. The second mechanical clearance is at the contacts between the projections 40 and the recessed areas 42, more precisely between the contact parts.

The first clearance J1 allows traverse movement of the platforms 32 in combination with the clearance at the means of attachment 34. The second clearance J2 enables the platforms 32 to rotate, and a displacement in the longitudinal direction of the machine, in combination with the clearance J3 in the means of attachment 34. Clearances J2 and J3 can be between 0.01 mm and 0.30 mm, preferably between 0.01 mm and 0.20 mm. The clearances can be different, especially J1, which can be larger than J2 or J3. It may, for example, be greater than 0.05 mm, or even greater than 0.50 mm. For aerodynamic reasons, it may be worthwhile to seal the clearance J1 with a silicone material. The smaller the required clearances, the greater must be the manufacturing precision, as when the range of clearances is narrow. These clearances enable relative rotation between the platforms 32 and therefore a change in the angular orientation of the blades.

When the blades are being designed, a theoretical angular orientation to achieve a desired operational performance is defined. At the same time as the design, the shapes of the lateral edges are fixed. To enable the assembly of a blade row, the mechanical clearances J1, J2 and J3 must be defined. Now, these latter enable the blades to rotate when tightening the means of attachment, which has the effect of twisting the angular orientations of the blades. Note that these errors in the blades' angular orientation are in the direction of rotation of the means of clamping. These errors also have an average value with a small standard deviation. Therefore, the blades are produced with an angular compensation for offsetting the error in angular orientation. Since the standard deviation of the error is small, the compensation angle allows for a blade row in which the variation in angular orientation is acceptable. Advantageously, the average angular orientation error and/or compensation angle is greater than 5', preferably greater than 30'. The compensation angle is generally proportional to the clearances J1, J2 and J3. Note that the compensation angle is oriented in the opposite direction to that of the tightening of the means of clamping. The calculation of the compensation angle may be based on average values of the mechanical clearances, as well as their standard deviations. Calculating the pitch differences may also take into consideration the geometric tolerances of the platform surfaces.

The present application exploits the clamping force and the geometry of the platform contours. The clamping force tends to make the platforms rotate in a given direction proportional to the size of the clearances. Making blades with a geometry that counters the positioning error enables the pitch to be set during assembly in accordance with an acceptable average value and a reduced standard deviation.

The teaching of the present application can be applied to a stage with stator or rotor blades that have platforms coming into contact with each other, and which are attached to a mounting using a means of fastening that can affect the angular orientation of the blades in one direction during the tightening of the means of clamping. The teaching of the present application can be used for blades whose lateral edges are substantially straight and free of bends.

Several methods can be used to assemble a blade row on its support. The method may comprise a step of successively placing blades in the housing 30. Then the method may comprise a step of successively tightening the means of clamping in turn, moving from one blade to the adjacent one. Attaching can be carried out from several starting points or starting blades. Interleaving platforms enables blade pitches to be maintained.

To improve the accuracy of setting the pitch, the method may include a preliminary step for mounting at least one reference blade 28A or marker blade. Preferably, at this stage, several reference blades are used, for example six for a row having a hundred and twenty blades in all. The reference blade 28A can be a conventional blade whose pitch is set and fixed after being attached. Then begins the step of placing the blades so as to form a blade row. At this point, the blades do not necessarily have their pitch set correctly. Then begins the step of successive clamping, using the means of clamping. Tightening the nuts is continuous, proceeding from one blade to its neighbour. Attachment may be performed starting from one side of a reference blade 28A, or from both sides.

If the manufacturing precision of the blades 28 is not as great, it is advantageous to increase the number of reference blades. Manufacturing costs can thus be reduced. Conversely, it is possible to reduce the number of reference blades if manufacturing precision is improved. Thus, the costs of pitch adjustment and testing of the reference blades can be reduced.

To further increase the accuracy of setting the pitch, it is possible, during the assembly stage, to use, as well as at least one reference blade, additional reference blades of another type. Such blades are similar to conventional blades, but have a widened platform and two means of attachment 34. These are fitted into two spaced holes, thereby precisely orienting the reference blade. The platforms have lateral edges enabling the adjacent blades to be rotationally locked at the pitch when they are assembled. The reference blade can be a dummy blade that includes a platform 32 with two means of attachment 34. The greater the distance between the holes being used, the greater is the precision with which the pitch can be set. This precision is achieved without the need to perform any measurement and testing operations. Thus, it is possible to save time and effort.

After the step of attaching the blades, the method comprises a step of replacing the dummy blades. This step leaves free spaces in the blade row formed during the step of placing the blades.

Therefore, the method comprises a further step of inserting and attaching the blades in the free spaces. These last blades have the benefit of the precision mounting of the blades that were in contact with the reference blades that were attached during the clamping step.

Figure 6:
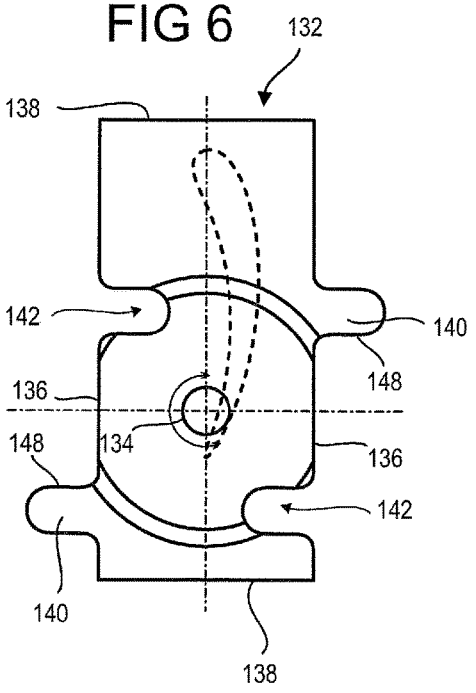
FIG. 6 illustrates a blade according to a second embodiment of the present application.

FIG. 6 illustrates a platform according to a second embodiment of the present application. FIG. 6 has the same numbering scheme as in previous figures for the same or similar elements, but the numbering is incremented by 100.

The platform 132 has a generally rectangular shape. It has transverse edges 138 and lateral edges 136 that each have mating tabs 140 and recesses 142. The tabs 140 and the recesses 142 are at some distance from the transverse edges 138. Their corners are rounded; they may, however project, for example at right angles. Each of the tabs 140 includes two contact parts, depending on the direction of blade rotation. The platform can thus ensure rotational locking in both rotational directions.

The platform 132 is more elongated than that shown in FIG. 3. It is suitable for a blade in which the pitch angle is closer to 0°, for example less than 10°. On this platform 132, the means of attachment are offset in relation to the body of the blade. Thus, the means of attachment may be moved away so as to correspond with the structure of a specific turbomachine.

Figure 7:
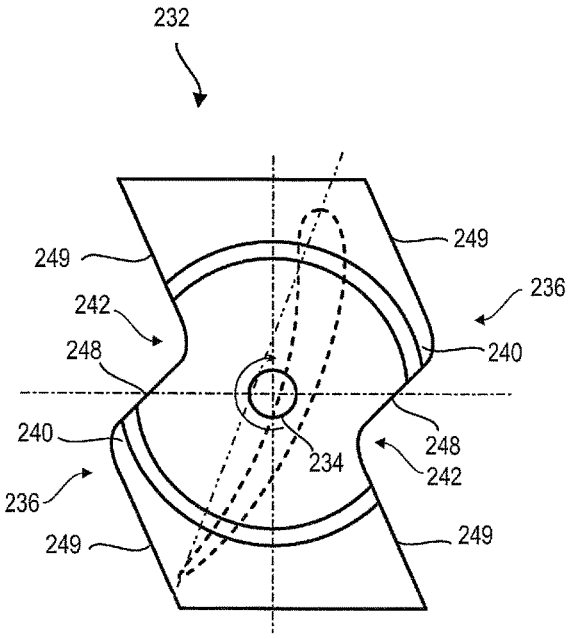
FIG. 7 illustrates a blade according to a third embodiment of the present application.

FIG. 7 illustrates a platform according to a third embodiment of the present application. FIG. 7 has the same numbering scheme as in FIGS. 3 and 4 for the same or similar elements, but the numbering is incremented by 200. Specific numbers are used for items specific to this embodiment.

Platform 232 is generally S-shaped so as to be suitable for a means of attaching with a right-hand thread. It comprises three parallelograms and is symmetrical with respect to its attachment axis 234. The profiles 236 of the lateral edges each have a central contact part 248 and two upstream and downstream parts 249. The upstream and downstream parts 249 are substantially parallel and the same length. The contact parts 248 form an angle close to 45° with the transversal direction and are in contact with the contact parts 248 of the adjacent blades. This platform configuration is designed for a means of attachment which is tightened clockwise. For a means of attachment that is tightened anti-clockwise, the profiles should be reversed, that is to say, symmetrical with those of FIG. 7 with respect to the longitudinal direction of the machine.

Figure 8:
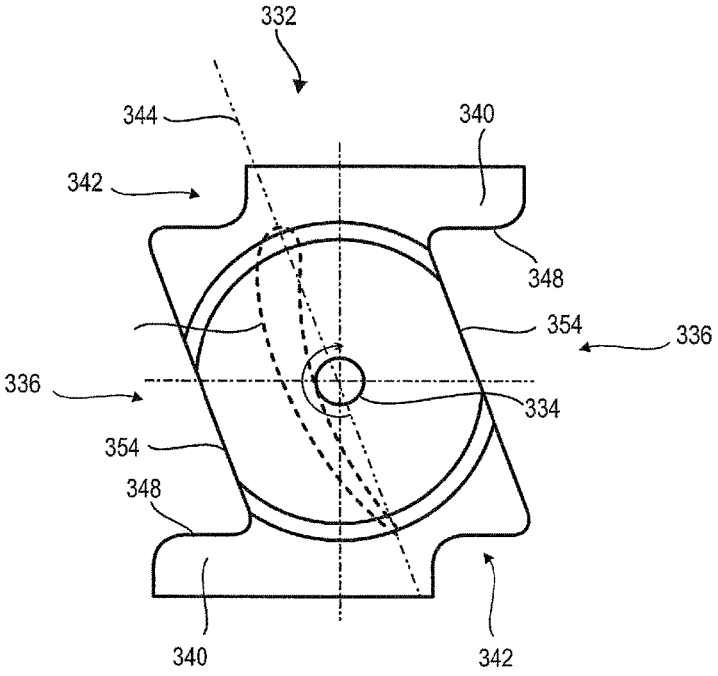
FIG. 8 illustrates a blade according to a fourth embodiment of the present application.

FIG. 8 illustrates a platform according to a fourth embodiment of the present application. FIG. 8 has the same numbering scheme as in FIGS. 3 and 4 for the same or similar elements, but the numbering is incremented by 300. Specific numbers are used for items specific to this embodiment.

Platform 332 is similar to that shown in FIG. 3. It comprises two generally parallel lateral edges 336. It has a general parallelogram shape with a reverse Z-shape. The general direction of the parallelogram is substantially parallel to the chord of the blade 344. By general direction is meant the direction of the long sides of the parallelogram. The platform 332 can be designed for blades having a pitch angle opposite to that shown in FIG. 3.

Platform 332 includes projections 340 and recesses 342 cut out from within the general shape of a parallelogram. The projections 340 form an acute angle with the longitudinal portions 354 of the lateral edges 336.

Figure 9:
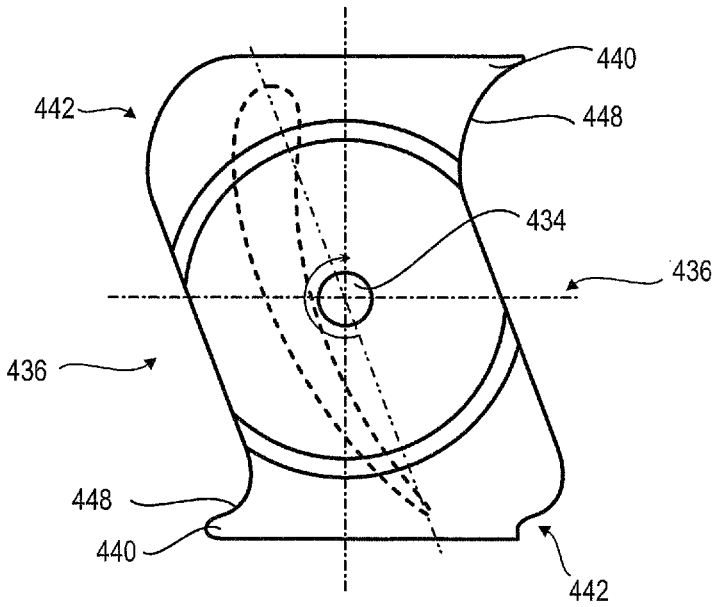
FIG. 9 illustrates a blade according to a fifth embodiment of the present application.

FIG. 9 illustrates a platform according to a fifth embodiment of the present application. FIG. 9 has the same numbering scheme as in FIGS. 3 and 4 for the same or similar elements, but the numbering is incremented by 400.

Platform 432 is generally parallelogram-shaped. It includes lateral edges 436 that form arc-shaped contact parts 448. The lateral edges 436 marry up with the adjacent lateral edges for most of their length. Part of their length cannot be in contact with the lateral edge of the adjacent blade.

Figure 10:
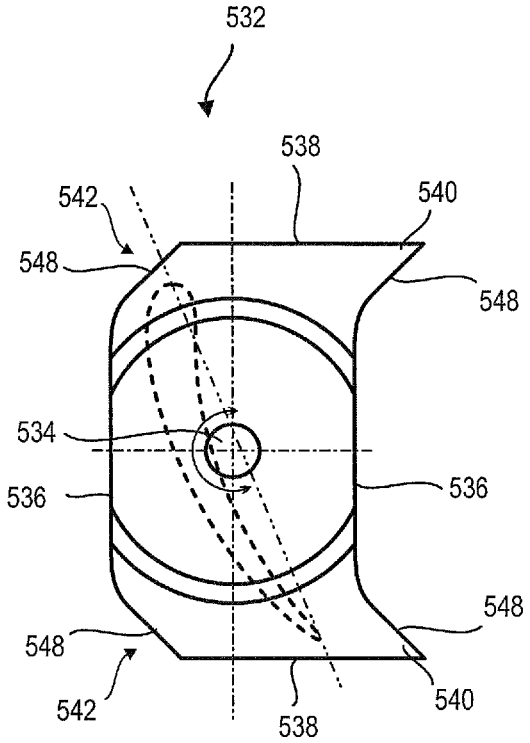
FIG. 10 illustrates a blade according to a sixth embodiment of the present application.

FIG. 10 illustrates a platform according to a sixth embodiment of the present application. FIG. 10 has the same numbering scheme as in FIGS. 3 and 4 for the same or similar elements, but the numbering is incremented by 500.

The blade comprises a platform 532 and a means of attachment 534. The platform 532 is generally C-shaped. The shape can be a reversed C. This platform is symmetrical relative to a transverse plane passing through the means of attachment 534.

Platform 532 includes lateral edges 536 and transverse edges 538. Each of the lateral edges 536 includes two contact parts 548. One contact part is on an upstream part of the edge and the other on a downstream part. These have opposite inclinations, which has the advantage that the lateral edge in question can bear against the adjoining edge of an adjacent blade independent of the direction of rotation.

The invention claimed is:

1. A method for assembling an annular row of blades on a ferrule of a stator of an axial turbomachine, comprising:

(a) fixing a reference blade substantially in a final angular position of the annular row of blades;

(b) successively placing a plurality of blades on the ferrule in order to form the annular row of blades, so as to align a blade row the annular row of blades with the reference blade;

(c) successively clamping a fixation portion of the plurality of blades forming the annular row of blades starting from the reference blade, so as to successively bring at least one contact part of an angular profile of each of the blades of the annular row of blades to bear on a corresponding contiguous profile of a contiguous blade of the annular row of blades.

2. The method in accordance with claim 1, wherein step (b) covers only part of a circumference of the stator, step (a) being carried out at several locations on the said circumference.

3. The method in accordance with claim 1, wherein the reference blade is a dummy blade equivalent to at least two contiguous blades of the annular row of blades, the method further comprising:

(d) replacing the dummy blade by blades in accordance with other blades of the annular row of blades.

4. The method in accordance with claim 1, wherein the at least one contact part of the angular profile of each of the blades of the annular row of blades is inclined to a rotation axis of the axial turbomachine by an angle greater than or equal to 20°.

5. The method in accordance with claim 1, wherein the at least one contact part of the angular profile of each of the blades of the annular row of blades is inclined to a rotation axis of the axial turbomachine by an angle greater than or equal to 45°.

6. The method in accordance with claim 1, wherein the at least one contact part of the angular profile of each of the blades of the annular row of blades is inclined to a rotation axis of the axial turbomachine by an angle greater than or equal to 70°.

7. The method in accordance with claim 1, wherein the at least one contact part of the angular profile of each of the blades of the annular row of blades is straight.

8. The method in accordance with claim 1, wherein each blade of the annular row of blades has an outer platform with an upstream edge and a downstream edge, the upstream edge and the downstream edge are straight and parallel, a rotation axis of the axial turbomachine being generally perpendicular to the upstream edge and the downstream edge.

9. The method in accordance with claim 1, wherein the fixation portion comprises: a portion for tightening by rotation, arranged at a centre of an outer platform, the at least one contact part of the angular profile being positioned to bear against the corresponding profile of a contiguous edge of an adjacent blade of the annular row of blades when the outer platform rotates in a direction of tightening of the fixation portion.

10. The method in accordance with claim 1, wherein the fixation portion comprises:

a stud extending from a face of an outer platform, the face serving as a mounting face to the ferrule.

* * * * *